US009481999B2

(12) United States Patent
Geller

(10) Patent No.: US 9,481,999 B2
(45) Date of Patent: Nov. 1, 2016

(54) METHOD OF BUILDING AND INSTALLATION OF AN INTERSTITIAL SEISMIC RESISTANT SUPPORT FOR AN ACOUSTIC CEILING GRID

(71) Applicant: Alvin Geller, Ventura, CA (US)

(72) Inventor: Alvin Geller, Ventura, CA (US)

(73) Assignee: Martin Integrated Systems, Orange, CA (US)

( * ) Notice: Subject to any disclaimer, the term of this patent is extended or adjusted under 35 U.S.C. 154(b) by 0 days.

(21) Appl. No.: 14/984,128

(22) Filed: Dec. 30, 2015

(65) Prior Publication Data

US 2016/0108635 A1 Apr. 21, 2016

Related U.S. Application Data

(60) Division of application No. 14/809,250, filed on Jul. 26, 2015, now Pat. No. 9,249,592, which is a continuation-in-part of application No. 14/250,069, filed on Apr. 10, 2014, now Pat. No. 9,127,455, which is a division of application No. 13/344,003, filed on Jan. 5, 2012, now abandoned.

(51) Int. Cl.

| | |
|---|---|
| ***E04B 2/00*** | (2006.01) |
| ***E04B 1/98*** | (2006.01) |
| ***E04H 9/02*** | (2006.01) |
| ***E04B 9/18*** | (2006.01) |
| ***E04B 9/30*** | (2006.01) |
| ***E04B 9/06*** | (2006.01) |
| ***E04B 9/10*** | (2006.01) |
| *E04C 3/04* | (2006.01) |

(52) U.S. Cl.

CPC . *E04B 1/98* (2013.01); *E04B 9/06* (2013.01); *E04B 9/10* (2013.01); *E04B 9/18* (2013.01); *E04B 9/30* (2013.01); *E04H 9/021* (2013.01); *E04H 9/024* (2013.01); *E04H 9/028* (2013.01); *E04B 2009/186* (2013.01); *E04C 2003/0413* (2013.01); *E04C 2003/0465* (2013.01)

(58) Field of Classification Search

CPC ..... E04B 9/30; E04B 9/18; E04B 9/34; E04B 9/00; E04B 2009/186; E04B 1/2612; E04F 2201/0517; E04C 2003/043; E04C 2003/0473; E04C 2003/0465

See application file for complete search history.

(56) References Cited

U.S. PATENT DOCUMENTS

| | | | |
|---|---|---|---|
| 276,241 | A | 4/1883 | Hanavan |
| 1,507,652 | A | 9/1924 | Youngberg |
| 1,854,968 | A | 4/1932 | Frederick |
| 1,861,615 | A | 6/1932 | Frederick |
| 2,057,092 | A | 10/1936 | Geib |
| 2,458,332 | A | 1/1949 | Boschan |
| 2,582,385 | A | 1/1952 | Knudsen |
| 2,723,816 | A | 12/1952 | Drysdale |
| 2,904,140 | A | 9/1959 | Cleary |

(Continued)

FOREIGN PATENT DOCUMENTS

| | | | |
|---|---|---|---|
| JP | 06-288032 | A | 11/1994 |

*Primary Examiner* — Brian Mattei
*Assistant Examiner* — Gisele Ford
(74) *Attorney, Agent, or Firm* — Lapple Ubell IP Law, LLP; Matthew C. Lapple

(57) ABSTRACT

A method for building and installing a ceiling suspension system including a plurality of rigid, elongated seismic joists interposed between opposing walls of a room, spaced selected distances apart along a horizontal support plane, and hangers suspended from the respective joists to support a grid from the respective lower ends thereof.

29 Claims, 14 Drawing Sheets

(56) References Cited

U.S. PATENT DOCUMENTS

| | | | | |
|---|---|---|---|---|
| 3,153,304 | A | 10/1964 | Evangelista | |
| 3,594,970 | A | 7/1971 | MacGrath | |
| 3,735,951 | A | 5/1973 | Reed | |
| 3,842,561 | A | 10/1974 | Wong | |
| 3,998,020 | A | 12/1976 | Kuhr | |
| 5,203,818 | A | 4/1993 | Kuiper | |
| 5,207,035 | A | 5/1993 | Fowler | |
| 5,697,195 | A | 12/1997 | Maylon | |
| 5,768,843 | A | 6/1998 | Dziedzic | |
| 6,029,414 | A | 2/2000 | MacLeod | |
| 6,345,800 | B1 | 2/2002 | Herst et al. | |
| 6,691,478 | B2 | 2/2004 | Daudet | |
| 6,729,096 | B1 | 5/2004 | Ashmore | |
| 6,761,005 | B1 | 7/2004 | Daudet | |
| 7,143,562 | B2 | 12/2006 | Krantz-Lilienthal | |
| 7,373,720 | B1 | 5/2008 | Jensen et al. | |
| 7,578,106 | B2 | 8/2009 | Burns et al. | |
| 7,730,690 | B2 * | 6/2010 | Miller | E04B 9/18 248/333 |
| 7,788,872 | B2 | 9/2010 | Platt | |
| 7,849,652 | B2 | 12/2010 | Lehane | |
| 2004/0172907 | A1 | 9/2004 | Krantz-Lilienthal | |
| 2006/0010812 | A1 | 1/2006 | Jones et al. | |
| 2007/0000201 | A1 | 1/2007 | Kennedy et al. | |
| 2007/0294979 | A1 | 12/2007 | Lin et al. | |
| 2010/0293884 | A1 | 11/2010 | Cecotti et al. | |
| 2011/0036051 | A1 * | 2/2011 | Callahan | E04C 3/07 52/843 |
| 2012/0042584 | A1 | 2/2012 | Sareyka | |
| 2012/0137614 | A1 | 6/2012 | Wendt | |

* cited by examiner

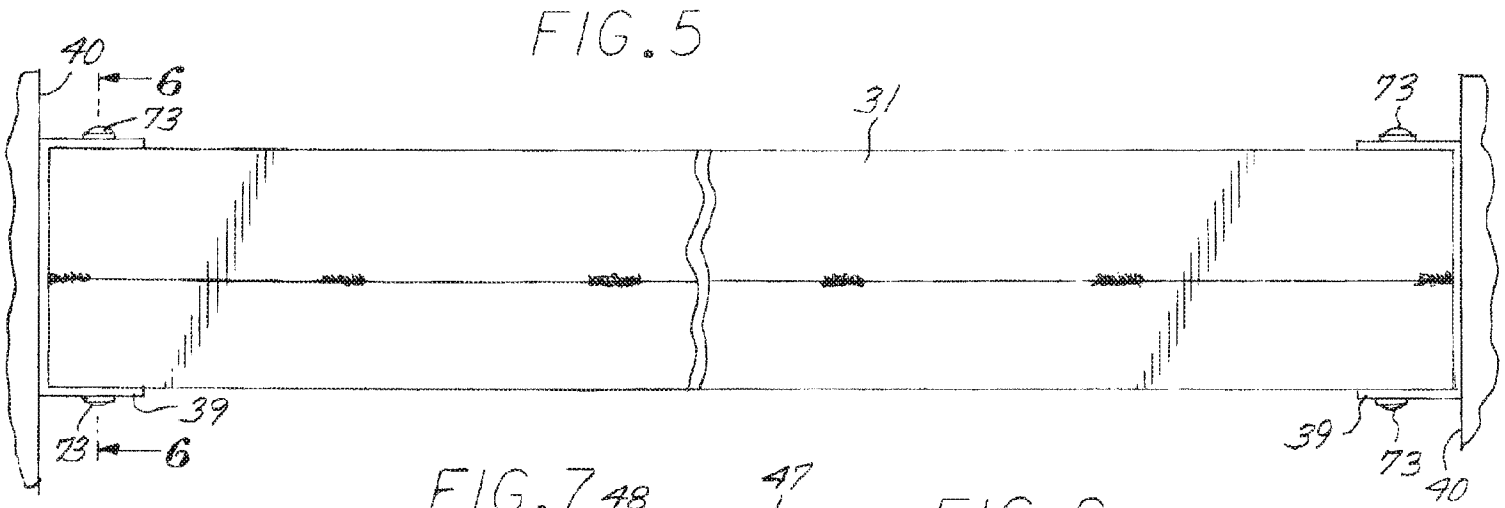
FIG. 5
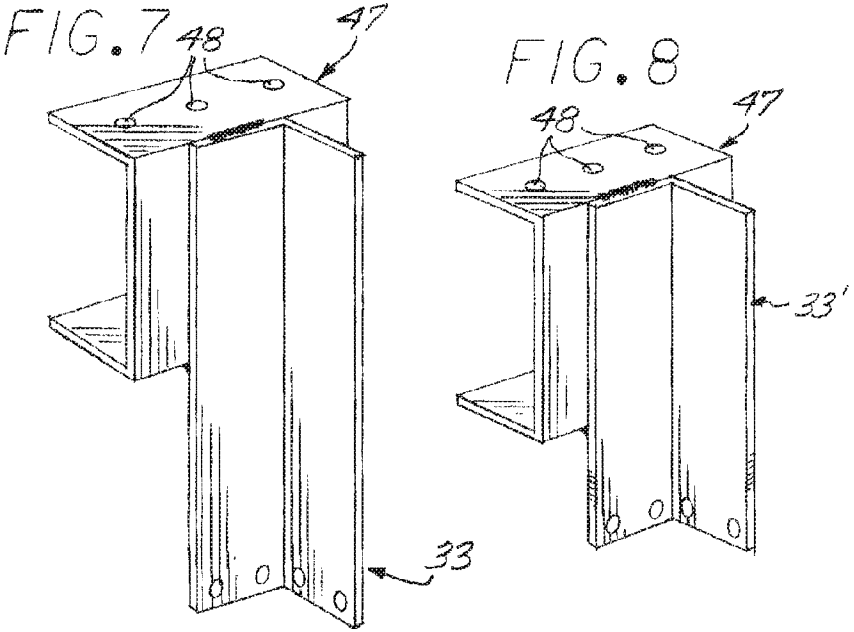
FIG. 7
FIG. 8
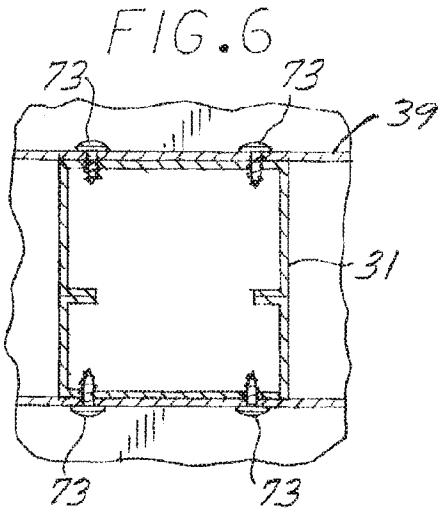
FIG. 6

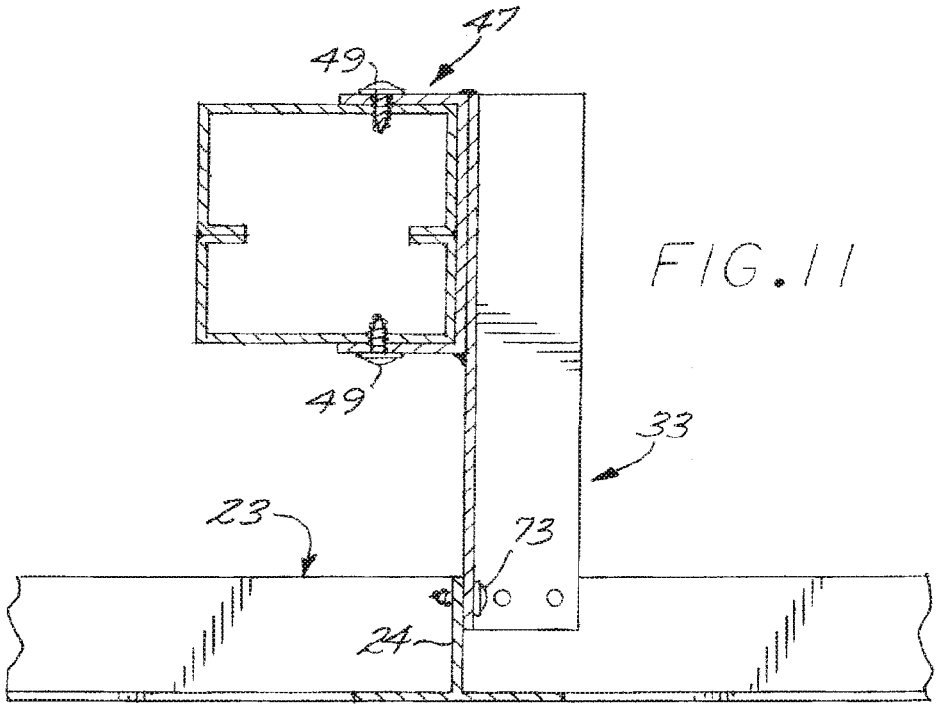
FIG. 11
FIG. 12
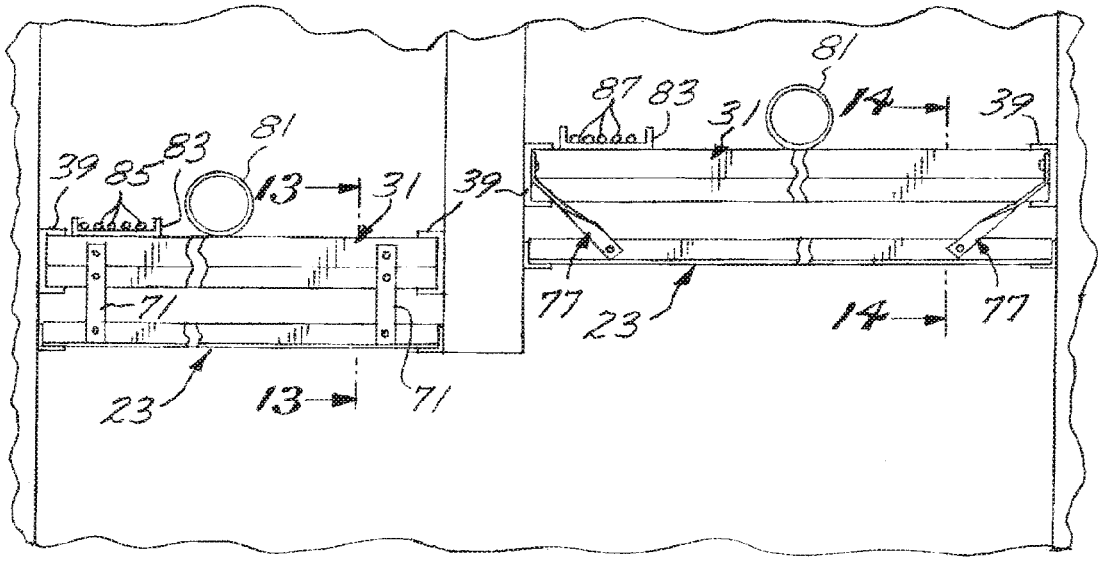

METHOD OF BUILDING AND INSTALLATION OF AN INTERSTITIAL SEISMIC RESISTANT SUPPORT FOR AN ACOUSTIC CEILING GRID

The teachings herein constitute a divisional of application Ser. No. 14/809,250, filed on Jul. 26, 2015, which is a continuation-in-part application Ser. No. 14/250,069, filed on Apr. 10, 2014 and issued as U.S. Pat. No. 9,127,455, which is a divisional application of application Ser. No. 13/334,003, filed Jan. 5, 2012, now abandoned, and the benefit of these earlier filing dates are claimed and the content thereof incorporated herein by reference as though fully set forth herein.

BACKGROUND

Field of the Invention

The present invention relates generally to seismic building construction and suspended ceilings.

Earthquakes propagate pulsating energy waves through the earth which result in vertical and horizontal ground motion. The ground motion rapidly reverses direction and has the greatest ground movement at the beginning of the earthquake, and then slowly decays in intensity. Buildings, supported on the earth by their foundations, tend to follow the ground motion. As the main structure of the building is moved back and forth by the earthquake, other parts of the building will independently respond to the building movements depending upon their stiffness and their mass (weight).

The opposite sides of ceiling grid are typically attached to the opposite walls of a hallway or the like and the grid will tend to move with the walls. It will be appreciated, however that as walls flex differently the grid will be exposed to different forces. It is common to design building structures to limit deflection to a maximum amount equal to the length in inches divided by 360. Thus, for a standard width hallway of eight feet, the allowed vertical and horizontal deflection is $^{96}/_{360}$ or 0.27 inches, such that the center of the ceiling grid would be limited to a translation of 0.27 inches relative to the hallway walls thus serving to limit or eliminate damage to the grid during an earthquake.

Stud walls within a building will flex and bend individually in response to the building's movements. For example, a stud wall with floor and wall-hung cabinets will have higher mass, and thus move differently than a wall without cabinetry. Elongated corridor and hallway ceilings have been severely damaged during seismic events when stud walls on opposite sides of a corridor are flexed and deflected inwardly toward the corridor (crushing the ceiling grid members), or flex outwardly away from the corridor (pulling the attached grid members apart).

Recent building codes require a "slip" joint on one wall in ceiling grid construction, recognizing the independent movement of both the opposing stud walls as well as the movement of the ceiling. The slip joints have been successful for small earthquakes, but are less effective in preventing ceiling damage with larger earthquakes. Most suspended grid ceiling systems are supported on wires attached to the overhead structure. Wire length is often 6 to 10 feet. Seismic splay wires, typically angling at a 45 degree angle to the horizontal, are even longer. Eye screws are attached to the structure above. The wire is looped through the eye screw or a hole in the grid and then wrapped back upon itself. During seismic events, the ceiling will often shift with the walls and stretch the wire loops to leave the wires slack. This resultant slack wires then allows for even greater ceiling translations and potential damage to the ceiling as an earthquake continues or in the event of a subsequent seismic event.

Efforts to address the damage to suspended ceilings have led to a proposal that a rigid strut be inserted between the overhead and ceiling grid work, purportedly to address issues relating to shock waves stemming from earthquakes and the like. A device of this type is shown in U.S. Pat. No. 3,842,561 to Wong. Such devices, while possibly having some benefit, have failed to provide the desired degree of resistance to maintain the grid during and succeeding a seismic event and do not address the problem of the opposite walls moving independently.

Other efforts have focused on the mass of ceiling suspended and have proposed an arrangement for segments of support beams to oscillate longitudinally independent of one another about an interposed gap. A device of this type is shown in U.S. Pat. No. 7,788,872 to Platt.

Still other efforts have led to proposals for a mounting clip to be anchored by fasteners directly to the adjacent wall and having a limited length of overhang for the horizontal leg of the clip. A device of this type is shown in U.S. Pat. No. 7,578,106 to Burns et al. Such devices leave the walls of the room or corridor free to flex independently and damage the ceiling grid and do little to limit translation of the grid relative to the walls.

SUMMARY OF THE INVENTION

The suspension system of present invention includes a plurality of elongated torsion and bend-resistant joists interspersed longitudinally between side walls of a room and abutted on their opposite ends to tracks carried from the wall studs thereby tending to maintain the wall spacing in the event of an earthquake. In one embodiment the ceiling grid is suspended from the joists by means of rigid vertical lever arm hangers.

The features and advantages of the invention will be more readily understood from the following detailed description which should be read in conjunction with the accompanying drawings.

BRIEF DESCRIPTION OF THE DRAWINGS

FIG. 5 is a transverse sectional view, in enlarged scale, taken along the line 5-5 of FIG. 1;

FIG. 6 is a vertical sectional view taken along the line 6-6 of FIG. 5;

FIG. 7 is a perspective view, in enlarged scale, of a lever arm defining a hanger incorporated in the suspension system shown in FIG. 1;

FIG. 8 is a perspective view of a lever arm similar to FIG. 7, but shorter;

FIG. 11 is a vertical sectional view along the line 11-11 of FIG. 9;

FIG. 12 is a broken vertical view depicting a condition where two different ceiling levels occur;

DETAILED DESCRIPTION OF EMBODIMENTS

Figure 1:
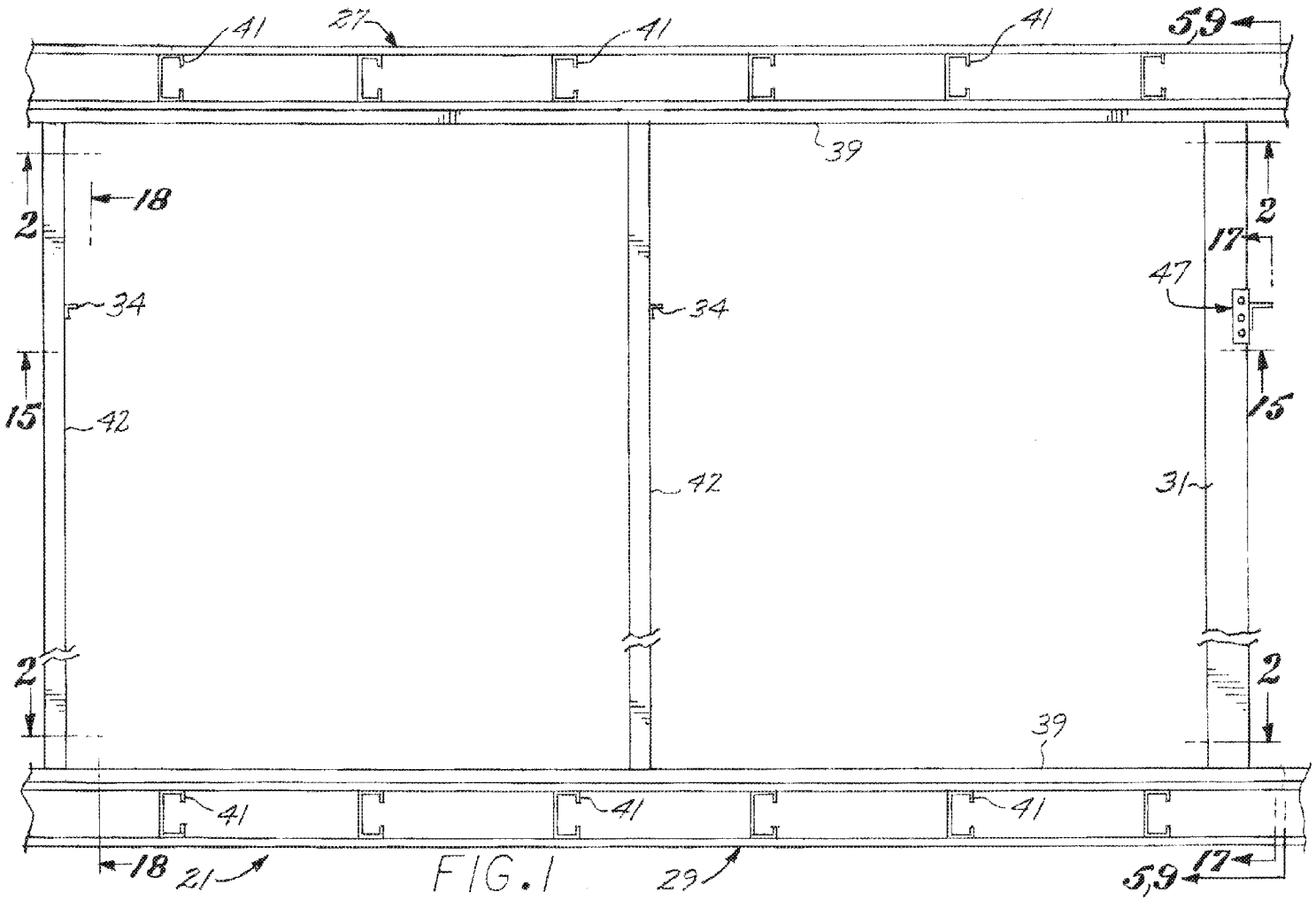
FIG. 1 is a broken top plan view showing the grid suspension system of the present invention.

The present invention includes, generally, a suspension system for suspending a ceiling grid 23 from the opposite walls 27 and 29 of a corridor, room or the like. The system 21 includes robust, transverse seismic joists, generally designated 31, interposed between the walls, spaced selected distances apart along the corridor and supported on their respective opposite ends from tracks mounted to the wall studs. For the purposes of my invention the term "seismic joist" is intended to mean a joist mounted over a room or hallway to opposed walls and constructed to resist the ceiling seismic forces and relative movement of the walls. In one preferred embodiment the grid 23 is suspended from the joists 31 by means of rigid vertical lever arms defining respective hangers 33 spaced apart laterally along the respective joists and configured to provide a substantial degree of rigidity and stiffness to restrict movement of the grid work 23 relative to the joists 31 and surrounding structure.

Figure 3:
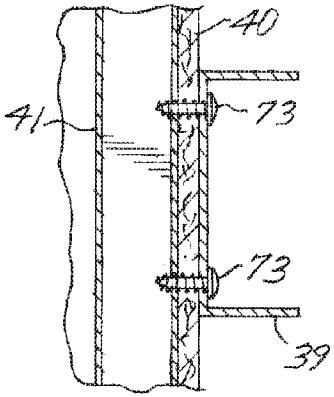
FIG. 3 is a vertical sectional view, in enlarged scale, taken along line 3-3 of FIG. 2.
Figure 9:
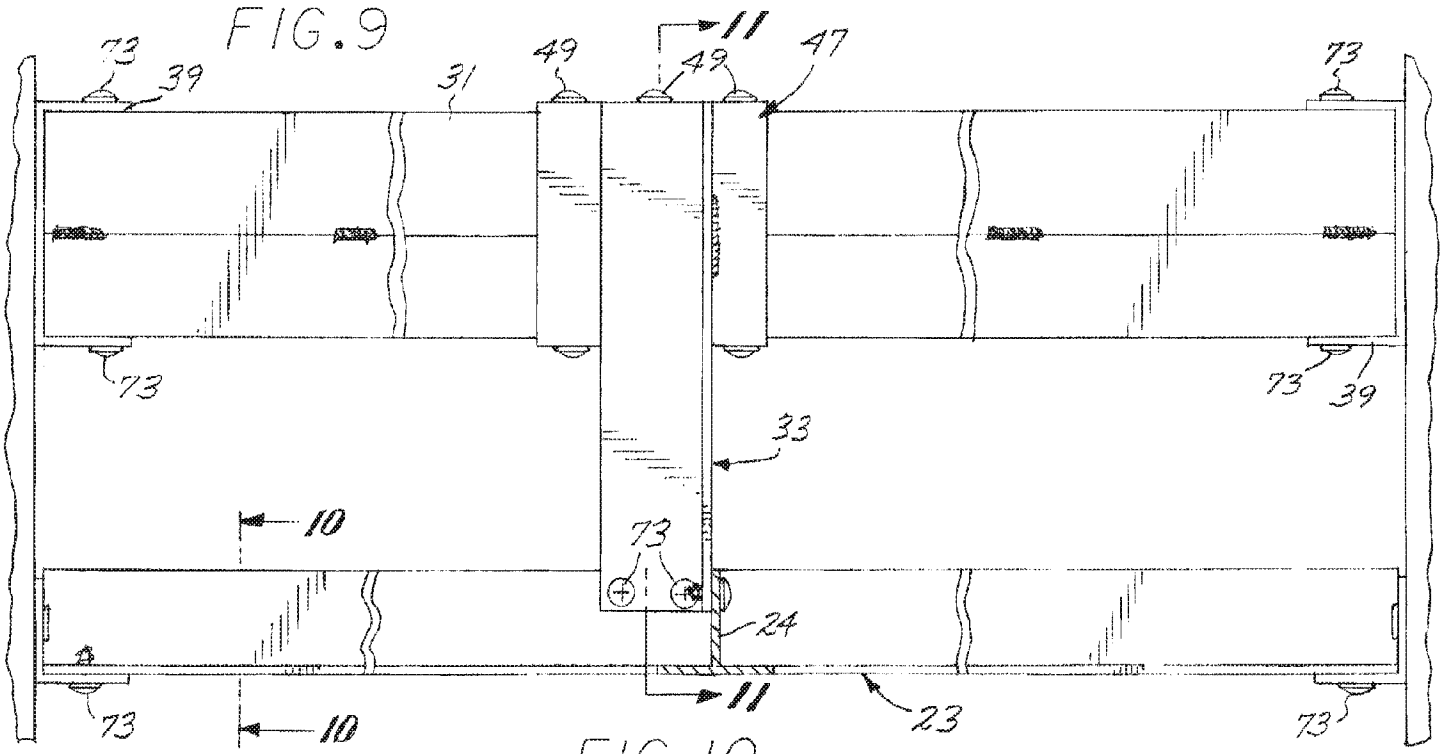
FIG. 9 is a vertical sectional view, in enlarged scale, taken along the line 9-9 of FIG. 1.
Figure 10:
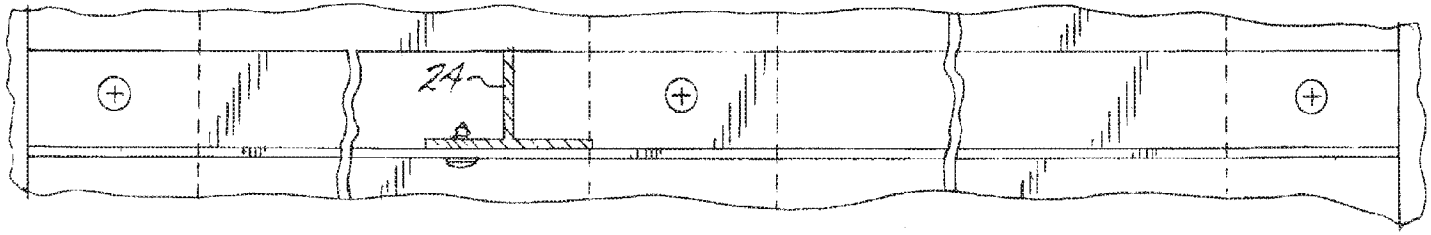
FIG. 10 is a vertical sectional view taken along the line 10-10 of FIG. 9.

In a preferred embodiment, I have elected to support my system from a pair of longitudinal, inwardly facing, channel-shaped tracks 39 which I abut against the drywall 40 (FIG. 3) and fasten directly or indirectly to the vertical studs 41 framing the opposite sidewalls of the corridor, as by #10 or #12 TEK screws (FIG. 3). The studs form no part of the present invention and may be conventional 16-gauge C-channels. I construct my tracks 39 of 3⅝ by 1¼ inch 20-gauge stud channels to form inwardly facing nesting cavities for the opposite ends of the respective joists. The ends of the joists 31 and 42 are received slidably in close fit relationship in the open sides of the tracks 39 and may be fastened thereto by, for instance, #10 or #12 TEK screws, top and bottom (FIG. 5).

For the seismic joists 31, it is important that they have relatively low weight-to-load-carrying capability so as to provide substantial resistance to the bending and torque loads applied thereto as the walls tend to shift relative to one another. For the joists of my preferred embodiment, I have selected box beam construction to be constructed of readily available 18-gauge steel C-channels with the opposite flanges abutted against one another and formed with seamed welds spaced there along at 12-inch intervals to form a tubular construction. In this exemplary embodiment, I have selected to install my system over a corridor approximately 12 feet wide, and accordingly, the seismic joists are approximately 12 feet long. For corridors or rooms of other widths, such as for example, 8 foot wide corridors, the system is equally useful, using seismic joists approximately 8 feet long, or as needed to span the applicable corridor or room. I have determined that, to meet building codes and provide for satisfactory construction in earthquake zones such as Southern California, the seismic joists can be spaced along the corridor at intervals of 8 to 16 feet or the like for particular applications. As will be appreciated, other spacing and constructions will be determined by the particular structural ceiling width and code(s) to be met. Other construction for the respective seismic joists would include rectangular, hexagonal or cylindrical tubes or square tubes such as a 4-inch by 4-inch steel tube, but such tubing typically comes in 11-gauge thickness, rendering it more challenging for applying fastening screws thereto. Ideally, a 16- or 18-gauge 3⅝-inch square tube would have particularly satisfactory application, it only being important for this invention that the seismic joists provide the desired resistance to torque and bending loads applied thereto by the suspended ceiling during a seismic event. In this regard it will be appreciated that the beam characteristics of a hollow tubular-type joist with the walls thereof spaced some distance from the axial center of the beam exhibit a relatively high resistance to torque and bending but other satisfactory configurations will occur to those of skill.

Figure 19:
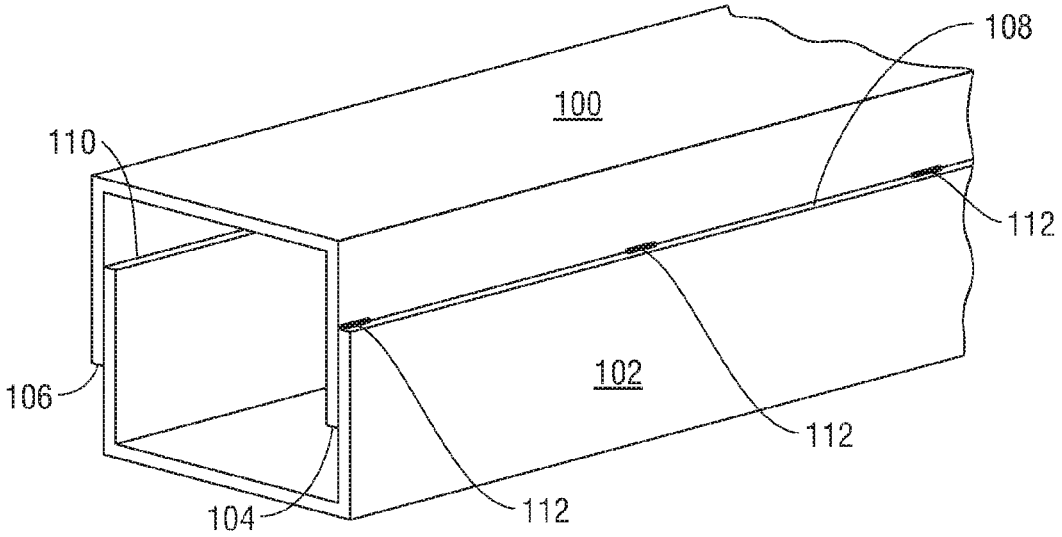
FIG. 19 is a perspective view, in enlarged scale, of an alternative embodiment of the seismic joist incorporated in the system shown in FIG. 1.

Other embodiments of the seismic joist are illustrated in FIGS. 19-22. As illustrated in FIGS. 19-22, the seismic joist may be any steel joist with a generally square or rectangular cross-section that provides the desired resistance to torque and bending loads. FIG. 19 illustrates another embodiment of the seismic joist in the form of two C-channel beams 100, 102, which are of generally the same width and height. Each of the C-channel beams 100, 102 have edges 104, 106, 108, 110 without any flanges. The C-channel beams 100, 102 are placed with the channels facing one another, but offset, such that edge 104 is located within the channel of C-channel 102, and edge 106 is located outside of the channel of C-channel 102. C-channel beams 100, 102 are wielded together at selected points 112, generally on 12 inch intervals, where outside edges 108, 106 contact the opposing C-channel. Opposing C-channels 100, 102 can also be secured to one another by use of screws or other suitable fasteners.

Figure 20:
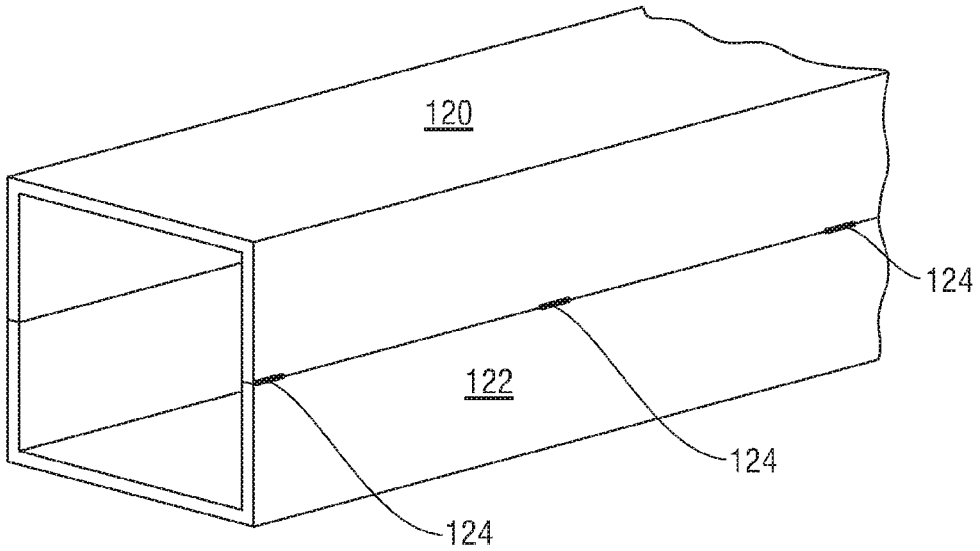
FIG. 20 is a perspective view, in enlarged scale, of another alternative embodiment of the seismic joist incorporated in the system shown in FIG. 1.
Figure 21:
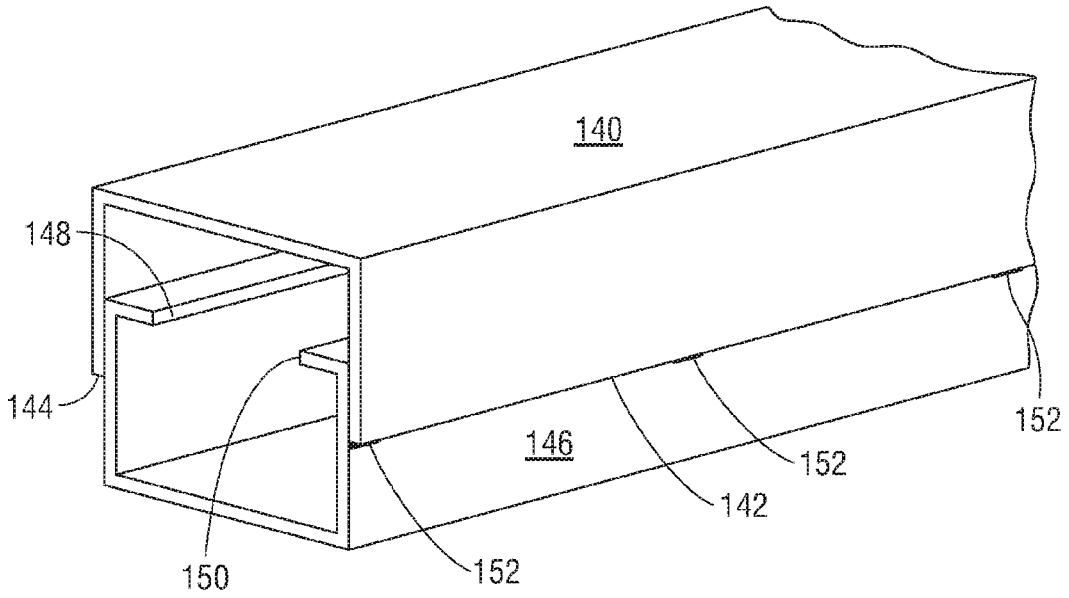
FIG. 21 is a perspective view, in enlarged scale, of another alternative embodiment of the seismic joist incorporated in the system shown in FIG. 1.
Figure 22:
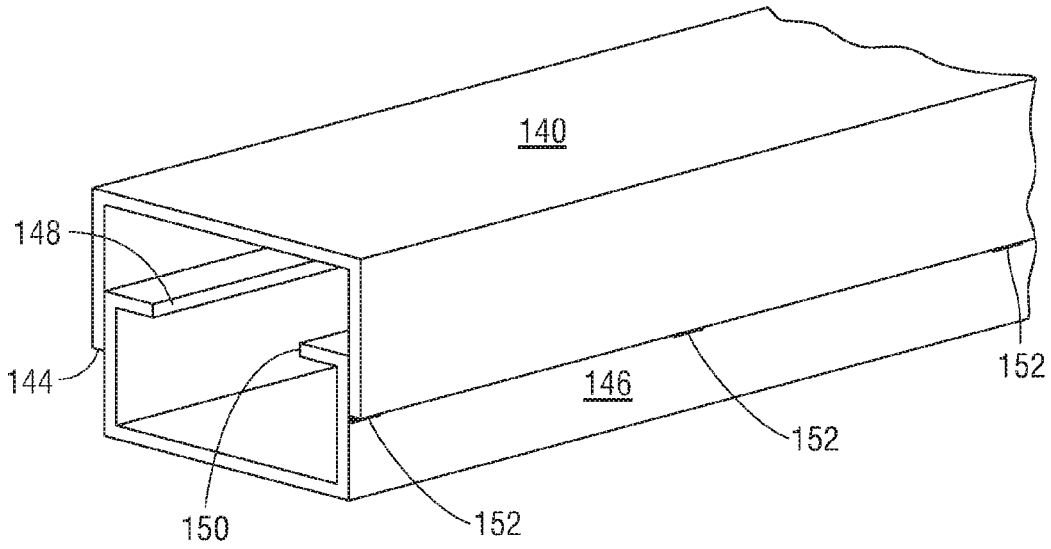
FIG. 22 is a perspective view, in enlarged scale, of another alternative embodiment of the seismic joist incorporated in the system shown in FIG. 1.

FIG. 20 illustrates an embodiment of the seismic joist with steel C-channels, 120, 122, which are of generally the same width and height. The C-channels 120, 122 have edges without flanges. C-channel edges are abutted against one another and formed with seamed welds 124 spaced there along at 12-inch intervals to form a tubular construction. FIG. 21 illustrates an embodiment of the seismic joist in the form of a C-channel beam 140, that has edges 142, 144 without flanges, placed facing another C-channel beam 146, also commonly known as a stud, that has edges with flanges 148, 150. C-channel beams 140, 146 are formed into a tubular steel seismic joist with seamed welds 152, spaced there along at 12-inch intervals. As shown in FIG. 22, seismic joists constructed of opposing C-channel beams (with or without flanged edges) may be configured to be rectangular in cross-section, as opposed to square.

In the preferred embodiment, the seismic joists are spaced along the respective walls 27 and 29 at intervals between 8-foot to 16-foot on center. For ceiling support between the respective seismic joists, I provide conventional C-channel support joists 42 nested on their opposite ends within the respective opposed tracks at 4 foot on center spacing to thus cooperate in supporting the grid.

Figure 15:
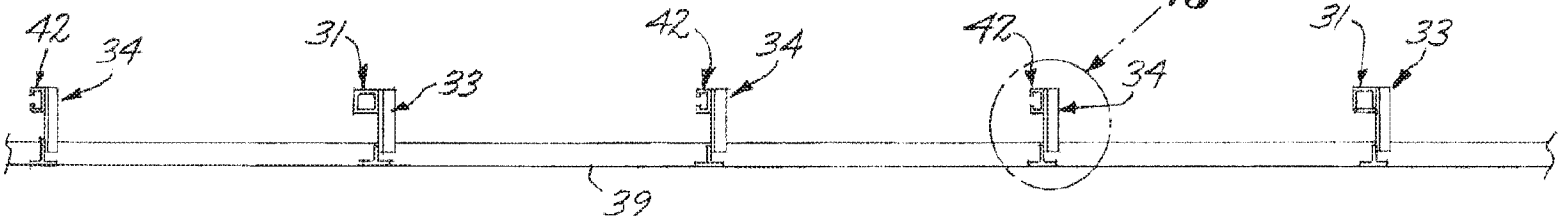
FIG. 15 is a vertical sectional view taken along the line 15-15 in FIG. 1.
Figure 16:
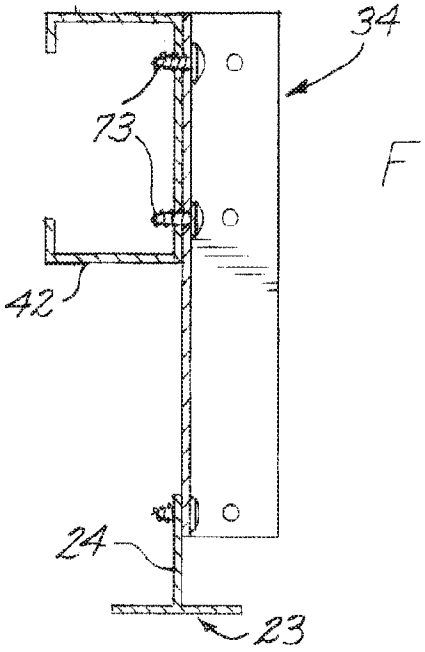
FIG. 16 is a vertical detail sectional view, in enlarged scale, taken from the circle 16 of FIG. 15.
Figure 17:
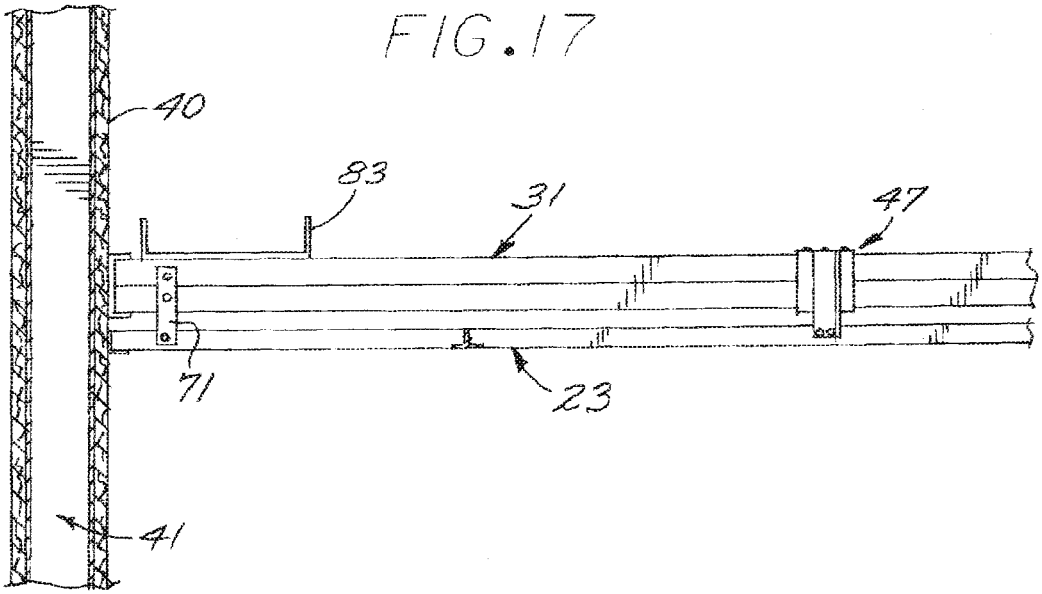
FIG. 17 is a vertical sectional view, in enlarged scale, taken along the line 17-17 of FIG. 1.
Figure 18:
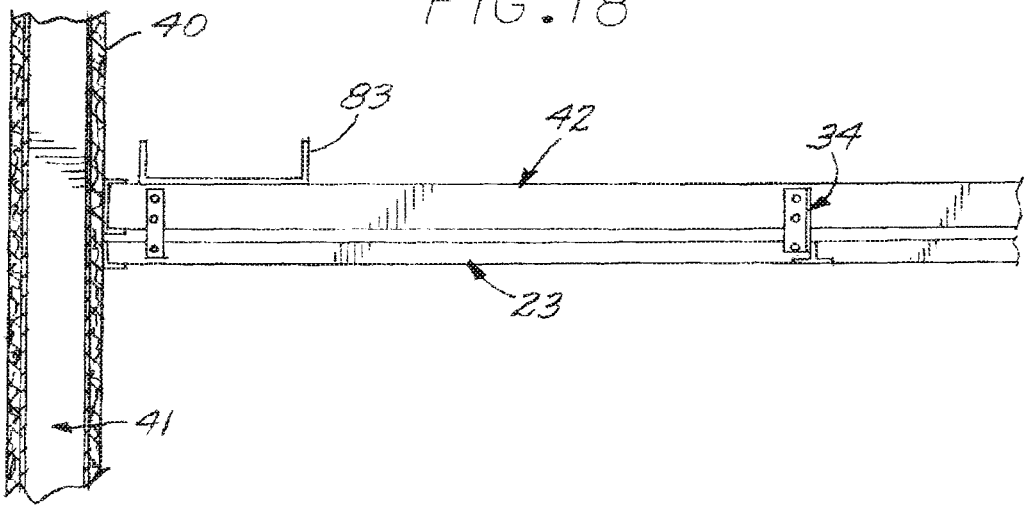
FIG. 18 is a transverse sectional view, in enlarged scale, take line 18-18 of FIG. 1 and showing a joist and hanger arrangement.

Hangers 34 (FIGS. 15 and 16), comparable to the hangers 33, carried from such joists will cooperate in supporting the weight of the grid. In the preferred embodiment, the lever arms defining the hangers 33 are constructed of 2-inch by 2-inch, or 2-inch by 2½-inch 18- to 12-gauge steel angle to resist bending as required by anticipated seismic forces, and are connected on their upper extremities to the respective joists 31, by means of rectangular C-channel mounting brackets 47 welded to the hangers and configured to engage in close fit relationship over top and bottom sides of the respective joists and are fastened to the joists by self tapping fastener screws 49 such as #10 or #12 TEK screws inserted through pre-drilled bores 48 to provide a slack-free connection. For the purposes of my invention, a "slack-free connection" is a connection where there is no relative movement between the parts once the connection is made.

For the purposes of my invention, the definition of "rigid hanger" or rigid "lever arm" has been limited to a rigid lever arm defined by steel angles, steel channels, steel studs, or equivalent constructed to, in the event of a seismic event, resist horizontal and vertical movement of the grid relative to the joists.

Figure 23:
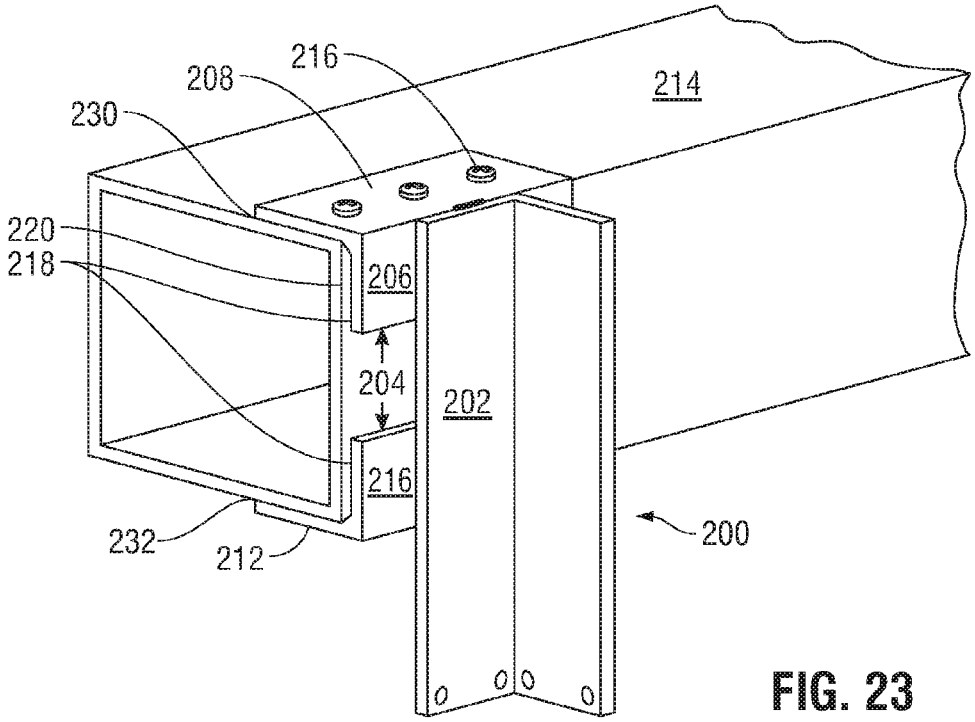
FIG. 23 is a perspective view, in enlarged scale, of an alternative embodiment lever arm defining a hanger incorporated in the suspension system shown in FIG. 1.
Figure 24:
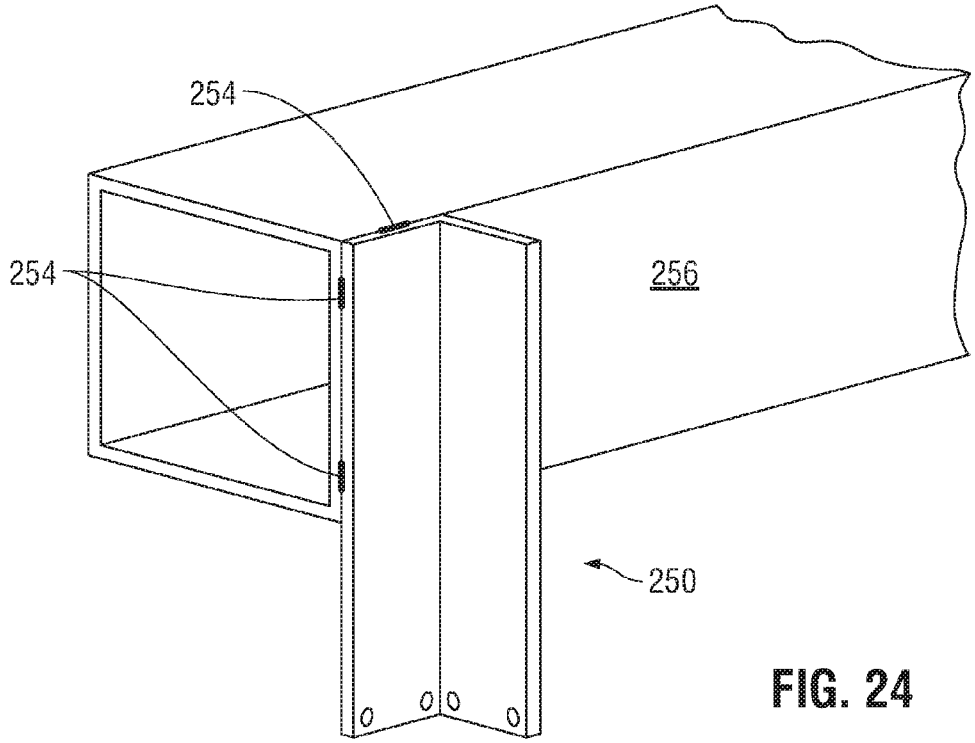
FIG. 24 is a perspective view, in enlarged scale, of an alternative embodiment lever arm utilizing a direct weld between the lever arm and the seismic joist.
Figure 25:
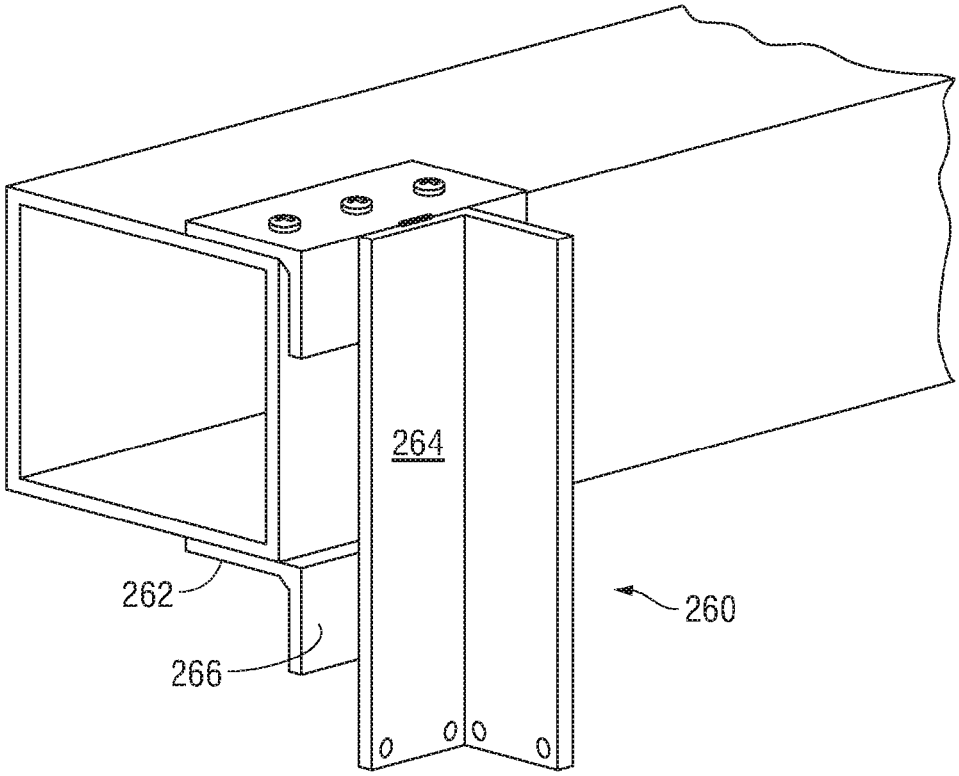
FIG. 25 is a perspective view, in enlarged scale, of another alternative embodiment lever arm defining a hanger incorporated in the suspension system shown in FIG. 1.
Figure 26:
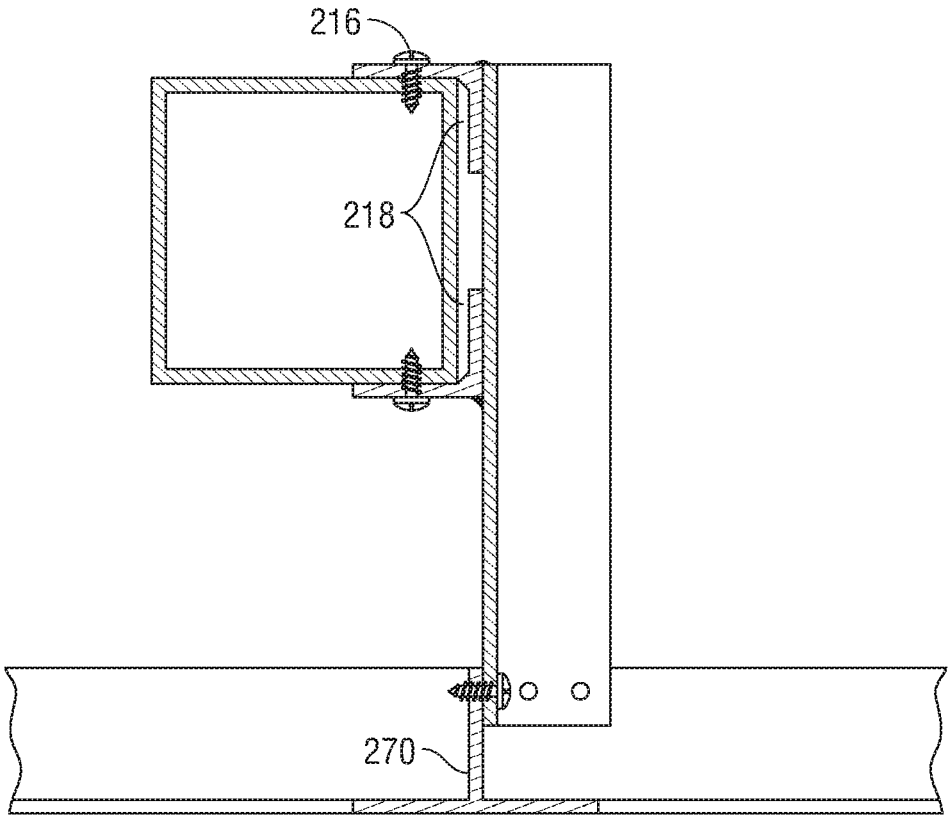
FIG. 26 is a vertical sectional view of an alternative embodiment of the hanger in place and affixed to a seismic joint and a ceiling grid.

FIGS. 23-26 illustrate alternate embodiments of the rigid hanger. FIG. 23 illustrates an embodiment of the hanger 200 in which the steel angle 202 is rigidly affixed to a two-piece bracket 204, consisting of an upper angle bracket 206 with a top flange 208, and a lower angle bracket 210 with a bottom flange 212. Preferably, upper angle bracket 206 and lower angle bracket 210 are each wielded to steel angle 202. When installed, as shown in FIG. 23, hanger 200 is rigidly affixed to a seismic joist 214 by self tapping fastener screws 216 such as #10 or #12 TEK screws inserted through pre-drilled bores to provide a slack-free connection. It will be appreciated that, so long as the attachment between hanger 200 and seismic joist 214 is slack-free, as a result of the close-fit relationship between the top 230 of the seismic joist 214 and the top flange 208, and between the bottom 232 of the seismic joist 214 and the bottom flange 212, there may be a gap 218 between the vertical side 220 of the seismic joist 214 and the two-piece bracket 204. FIG. 26 illustrates a cross-section of the hanger embodiment shown in FIG. 26, attached to a ceiling grid 270.

FIG. 24 illustrates an embodiment of the rigid hanger 250 that consists of a steel angle 252 that is directly wielded 254 to the seismic joist 256.

FIG. 25 illustrates an embodiment of the rigid hanger 260 in which the lower angle bracket 262 is oriented and rigidly affixed to steel angle 264 in such a way that the vertical flange 266 projects downwardly, in contrast to the upwardly projecting embodiment shown in other figures included herein. The installation of this embodiment of the rigid hanger is shown in FIG. 26.

Figure 27:
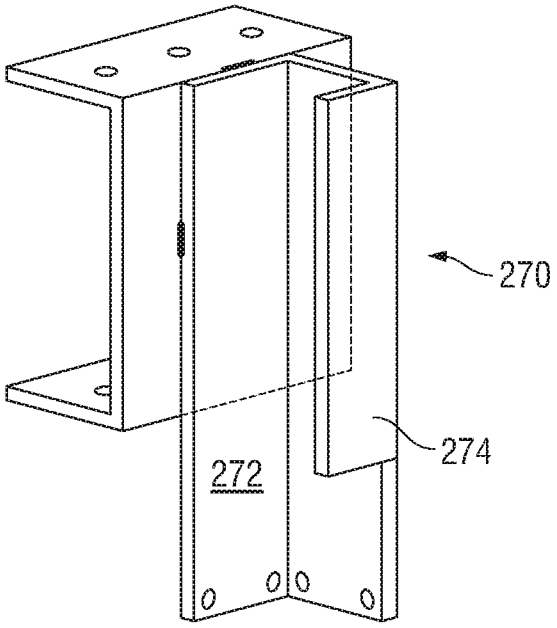
FIG. 27 is a perspective view, in enlarged scale, of another alternative embodiment lever arm defining a hanger incorporated in the suspension system shown in FIG. 1.

FIG. 27 illustrates another embodiment of the rigid hanger 270 in which the rigid lever arm 272 is formed from a steel channel, rather than a steel angle. In this embodiment, a section of the outer portion 274 of the channel-formed rigid lever arm 272 has been removed at the lower extremity of the rigid lever arm 272 to allow for efficient attachment to the ceiling grid and to avoid blocking ceiling tiles after installation, and thereby preventing them from being raised for such activities as maintenance and replacement, or access to the plenum.

It will be appreciated that the rigid hanger lever arms act as relatively rigid hangers to resist relative movement between the respective joists 31 and the conventional lay-in tile ceiling grid 23 without the necessity of any supplemental type of bracing or splay wires. In practice, these lever arms or hangers 33 are spaced laterally apart toward the opposite sides of the corridor and may be sufficiently long to suspend the grid 23 to, in the event of a seismic event, to minimize vertical and horizontal movement of the ceiling grid.

Figure 13:
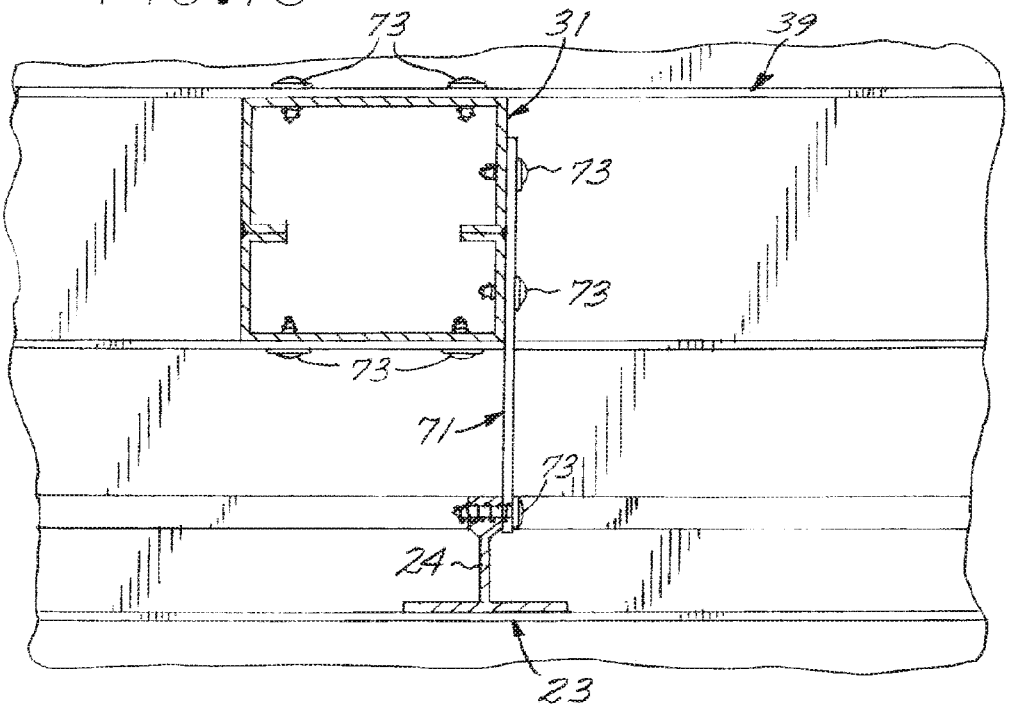
FIG. 13 is a vertical sectional view, in enlarged scale, taken along the line 13-13 of FIG. 12.

Referring to FIGS. 1, 12, 13 and 14, at various locations there may be different means for supporting the grid work. Referring in particular to FIGS. 12 and 13, the opposite sides of the grid may be nested in upwardly facing angles mounted to the opposite walls and the hanger from the seismic joists 31 and 42 near the opposite sides of the grid may be in the form of vertical metal straps 71 connected to the joist by means of self-tapping screws 73 screwed into pre-drilled bores along one wall of the joist. Then, on the bottom extremity, the strap 71 is connected to the vertical flange of a T-flange 24 by means of a self-tapping screw 73 screwed into such flange.

Figure 14:
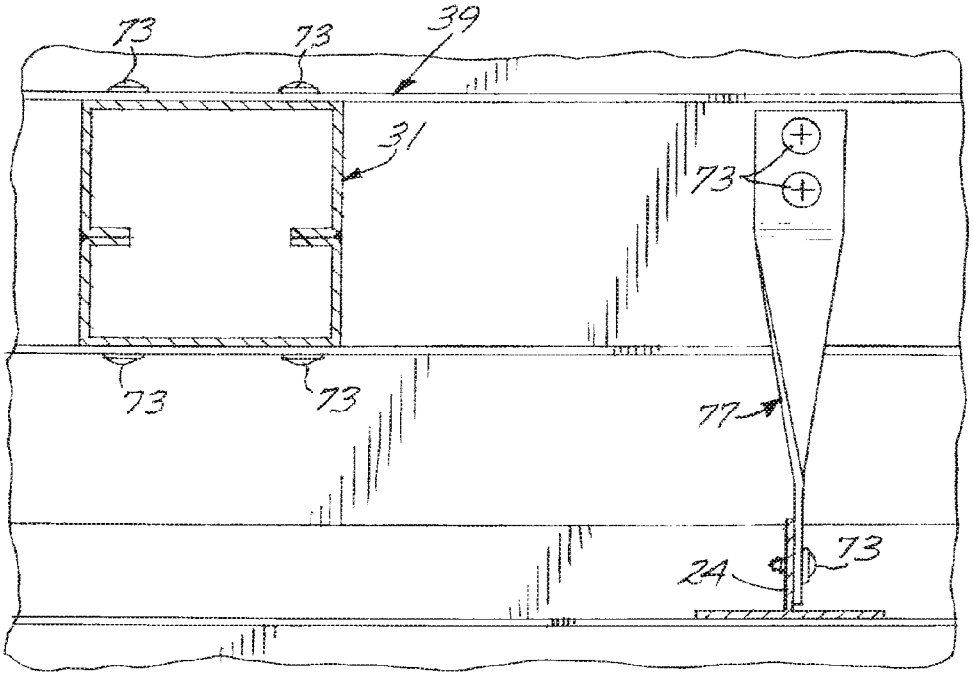
FIG. 14 is a vertical sectional view taken long the line 14-14 of FIG. 12.

Referring to FIG. 14, in this arrangement, the vertical flange 24 at the end of the grid 23 is attached directly to the track 39 by means of downwardly and inwardly angled, twisted strap 77 utilizing a self-tapping screw 73.

For different heights and elevations, it will be appreciated that the vertical hangers 33 will be configured of different lengths, such as the hanger 33' shown in FIG. 8, which has a length below the top of joist 31 of approximately five inches, as compared to the bracket 33 having a length below the top of joist of about 11 inches. As will be appreciated by those skilled in the art, these lengths will be determined by an analysis of the construction of the building intended to receive the support system and depending on the height of the plenum area above the suspended ceiling which is to be dedicated to various devices and component for conveyance of electrical current, fluids and pneumatics, and the like. In practice, I have found that a plenum height in the area of between 6 and 12 inches is sufficient for most applications.

It will be appreciated that, with the instant invention, the engineer or designer will typically have access to architectural drawings and blueprints to determine the width and length of the hallway or room, weight and construction of the corridor walls, the intended height of the suspended ceiling, and specifications on the size and weight of the grid work and ceiling panels to be supported, as well as building code for seismic requirements in the area of the intended installation. He or she can then determine the contours of the space available for installation, and determine the length, size and configuration of joists required to carry the bending and torque loads expected to be applied due to loads placed on the respective walls during a seismic event.

As set forth above, I have discovered that for my particular application, conventional metal construction is desirable with the various gauges and sizes described above. It is intended, however, that the scope of this invention will be defined by the appended claims and that from this disclosure other gauges, configurations and materials will be apparent for various applications.

In any event, working from this disclosure, architects, engineers and designers will have the details of the construction available from which they can complete the design work for the particular applications. In various sections of the building, depending on height, transitions and the like, the horizontal plane(s) for the joists and for the suspended ceiling will be determined and the hangers selected and fabricated to accommodate those various vertical distances between the various planes. I have found that there is benefit to constructing the support joists, seismic joists, hangers and mounting brackets in a production line, and in most instances locating and pre-drilling the mounting holes for the mounting fasteners such as screws to thereby expedite the installation task and keep the skill required of the installing technicians to a minimum.

Thus, as will be apparent from the following, the system may be conveniently and quickly installed without the necessity of accessing the ceiling area for mounting the upper ends of suspension wires or the tedious anchoring of the wire ends, looping and twisting and, in the end, resisting damage to the ceiling components in the event of an earthquake. The system can be rapidly installed to then make the installation area available for others in the trade for installation of plumbing, electrical and ductwork and the like, thus contributing to the efficiency of construction. While the sequence of installation is not important to this invention, I will describe one possible sequence, recognizing that other sequences may be followed without departing from the spirit of the invention.

In this regard, it will be appreciated that the installers can efficiently position the respective channel tracks 39 in a selected horizontal plane abutted against the drywall 40 and facing toward one another from the opposite walls of a corridor, drill holes in alignment with the respective studs, and install screws 73 to mount the tracks to the respective studs (FIG. 3).

Figure 2:
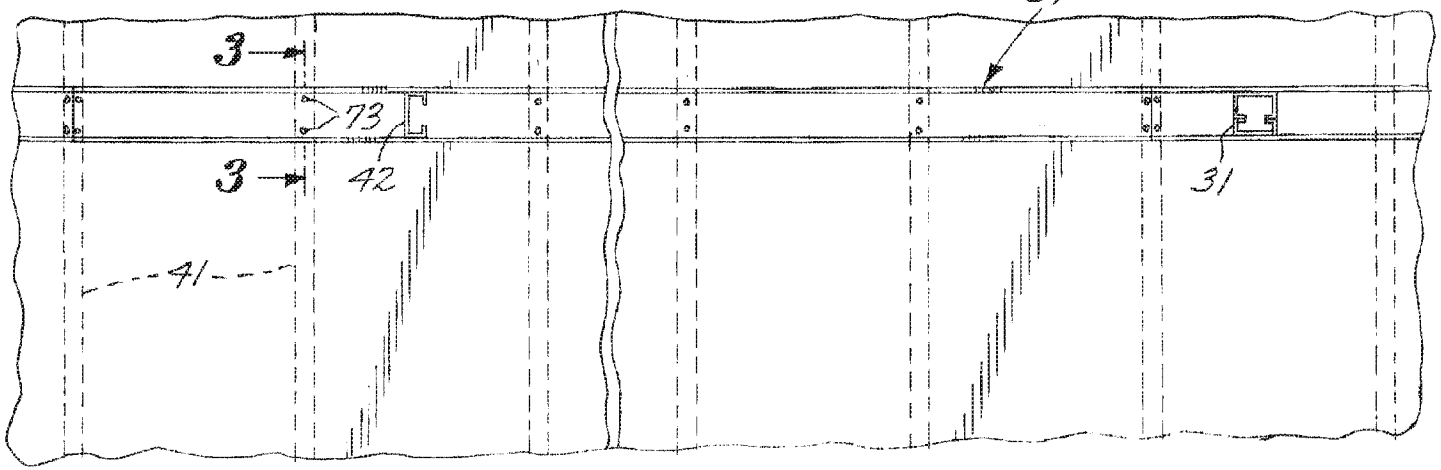
FIG. 2 is a sectional view taken along line 2-2 of FIG. 1 and depicting a track mounted to one of the sidewalls of a hallway from which the suspension system in FIG. 1 is supported.
Figure 4:
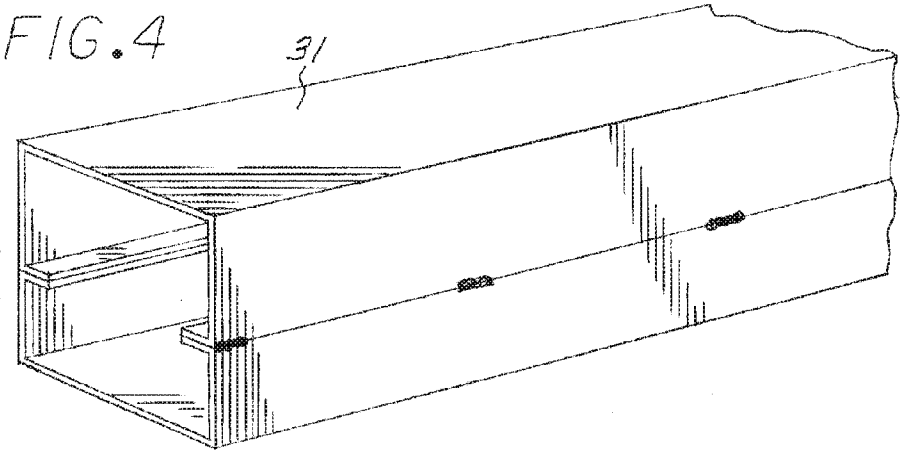
FIG. 4 is a perspective view, in enlarged scale, of a seismic joist incorporated in the system shown in FIG. 1.

Sections of the track 39 may be abutted longitudinally together as shown in FIG. 2 and a splice 60 inserted and the respective marginal ends of the sections screwed thereto by means of mounting screws 73 received in pre-drilled bores.

Referring to FIGS. 1, 9, 15 and 16, the grid for the ceiling may then be moved into place at the desired height spaced below the plane of the tracks.

The opposite ends of the respective support and seismic joists 42 and 31 may then conveniently positioned in close fit relation to the open sides of the respective tracks 39, holes drilled and mounting screws 73 screwed in such track and joists (FIG. 5), to thereby secure the joists closely fitted in the tracks to provide support against shifting and twisting relative to such track.

The workmen may then select the hangers 33 and 33' and cut them to the respective desired lengths to be mounted to the respective joists 31 by fitting the brackets 47 over the sides of the respective joists 31, located over the respective vertical webs in the lay-in tile ceiling grid and insert the mounting screws through the pre-drilled holes in such brackets (FIG. 9), with the hangers 33 or 33' aligned over the grid. Such hangers 33 and 33' can also be pre-fabricated off-site. The mounting screws 73 may be inserted through the pre-drilled holes in the lower extremities of the hangers and vertical flanges of the grid to make a positive movement free connection. The straps 71 and 77 (FIGS. 13 and 14) may then be installed as described to provide additional support for the grid. Straps and angles may then also be mounted from the joists 42 to provide further support for the grid (FIG. 11).

With this stage of construction completed, the workmen may proceed with installing components in the plenum chamber above the suspended ceiling, such as air ducts 81, conduit trays 83 and electrical conduits and the like (FIG. 12). As will be appreciated by those skilled in the art, heavier components such as the air ducts are separately suspended from overhead. The placement of ceiling panels, grates and registers, lighting panels and the like on the grid work will likewise be scheduled at the option of the contractor. As will be appreciated by the artisan, the weight of the ceiling panels and components in total mounted on the gridwork may be considerable, thus combining to generate considerable momentum to apply considerable loads to the hangers in the event of a seismic event.

When the entire installation is complete and the building construction has passed inspection, the building will be ready for occupancy, the quarters and hallways will be available for foot and cart traffic and the like, and the air ducts 81 and various conveyance cables 85 and 87 will be available for transmission of fluids, pneumatics, electrical signals and the like. It will be appreciated that in many buildings this requirement for conveyance of fluids and signals in the plenum chamber above the suspended ceiling is considerable, thus exhibiting a demand for a relatively high volume plenum chambers and for a suspension system having rather robust support capabilities and resistance to unwanted relative shifting of opposing walls during earthquakes.

In this regard, it will be appreciated that in the unfortunate event of an earthquake, one will expect that the building will be shifted oftentimes tending to impart somewhat independent movement to the hallway walls as the opposing walls tend to shift, flexing portions thereof toward or away from one another. It will be appreciated that such tendency of the walls to flex relative to one another will be resisted by, for instance, as the walls tend to flex toward one another, the column strength of the joists 31 and 42 acting against the respective tracks 39 to thus avoid crushing the grid or pulling the grid apart.

Also, to the extent there is any actual translation of the joists 31 and 42, the hangers will tend to shift the ceiling grid in unison therewith and will tend to maintain a rigid, motion free connection with such ceiling grid to resist relative movement to thus avoid the ceiling moving independently and crashing into the adjacent walls and administering damage to the drywall and the like thereby tending to minimize the degree of repair work to be completed after the earthquake.

In this regard it will be understood that the cantilever actions of the hangers that tends to shift the ceiling grid with the joists will, upon rapid shifting, apply considerable torque to the joist as resisted by the mounting brackets 47 closely fit over the joists as well as the angular cross section of such hangers thereby applying toque to the joists. Rotation of the joists about their own longitudinal axes is resisted by the nesting of the separate ends thereof in close fit relationship in the open sides of the respective tracks 39 to thus take advantage of the rigid elongated tracks anchored to the wall studs.

From the foregoing, it will be apparent that the present invention provides an economical and convenient means for suspending a drop ceiling from opposing walls in a manner which will resist damage from earthquakes and the like and which in some embodiments also affords the benefit of providing a relatively unobstructed plenum area above the suspended ceiling for conveyance of air ducts, electrical fluid, pneumatic components and the like. My method of manufacture and installation provides for economical manufacture and rapid and convenient on site installation.

The invention may be embodied in other forms without departure from the spirit and essential characteristics thereof. The embodiments described therefore are to be considered in all respects as illustrative and not restrictive. Although the present invention has been described in terms of certain preferred embodiments, other embodiments that are apparent to those of ordinary skill in the art are also within the scope of the invention. Accordingly, the scope of the invention is intended to be defined only by reference to the appended claims.

I claim:

1. A method of making and installing a suspension system for supporting a ceiling grid in a horizontal grid plane over a room and resisting vertical and seismic forces, with at least two walls positioned opposite from one another, comprising:

selecting tracks to be positioned in a horizontal support plane spaced above the grid plane mounted to the respective opposite walls of the room;

selecting seismic joists of a length to extend between the tracks when mounted to the respective walls;

selecting rigid lever arms attachable to the respective seismic joists to support the grid and of a length sufficient to, when the seismic joists are positioned in the support plane, position the grid in the grid plane, each rigid lever arm affixed to a hanger bracket;

wherein each hanger bracket has an interior and an exterior, said exterior abutting one side of an upper extremity of the respective rigid lever arm, the interior of the hanger bracket defining a C-shaped bite that is configured to engage in close fit relationship over the top and bottom sides of each of the respective seismic joists;

configuring and sizing the joists, hanger brackets and rigid lever arms to, when installed, position the grid in the grid plane;

at a construction site, mounting the tracks to the respective walls in the support plane;

interposing the seismic joists between the tracks;

fastening the seismic joists to the tracks;

positioning the hanger brackets on the respective seismic joists; and fastening the hanger brackets to the seismic joists.

2. The method of claim 1 further comprising:

fastening the rigid lever arms to the ceiling grid.

3. The method of claim 1 further comprising:

selecting conventional joists of a length to extend between the tracks when mounted to the respective opposite walls of the room;

selecting vertical supports to connect to the conventional joists and support the grid and of a length sufficient to, when the convention joists are positioned in the support plane, position the grid in the grid plane;

interposing the conventional joists between the tracks; and fastening the vertical supports to the conventional joists;

fastening the vertical supports to the ceiling grid.

4. The method of claim 3 further comprising:

at the construction site, installing a cable tray above one or more of the respective seismic joists and conventional joists.

5. The method of claim 3 wherein at least one conventional joist is positioned between each seismic joist.

6. The method of claim 1 wherein the step of selecting seismic joists further comprises:

wherein the seismic joists are constructed of metal and are tubular in cross-section.

7. The method of claim 6 wherein the step of selecting seismic joists further comprises:

wherein the tubular seismic joists are box beams.

8. The method of claim 1 wherein the step of fastening the hanger brackets to the seismic joists further comprises:

fastening the hanger brackets to the seismic joists with self-tapping screws.

9. A method of making and installing a suspension system for supporting a ceiling grid in a horizontal grid plane over a room and resisting vertical and seismic forces comprising:

selecting tracks to be positioned in a horizontal support plane spaced above the grid plane, said respective tracks to be supported from a first wall and a second wall that is not perpendicular to and is spaced a distance apart from the first wall;

selecting seismic joists of a length to extend between the tracks when mounted to the respective first wall and second wall;

selecting a plurality of hangers for the seismic joists, each of which comprises a metal hanger bracket rigidly affixed to a downwardly projecting vertical rigid lever arm that is connectable to the ceiling grid and wherein the rigid lever arm is of a length sufficient to, when the seismic joists are positioned in the support plane, position the ceiling grid in the grid plane;

wherein the metal hanger brackets, having respective interiors and exteriors, said respective exteriors abutting one side of the upper extremities of the rigid lever arm, the respective interiors of the metal hanger brackets defining C-shaped bites that are configured to engage in close fit relationship over the top and bottom sides of each of the respective seismic joists;

configuring and sizing the seismic joists and hangers to, when installed, position the grid in the grid plane;

at a construction site, mounting the tracks in the support plane to the respective wall first wall and second wall;

interposing the seismic joists between the tracks;

fastening the seismic joists to the tracks;

positioning the respective hangers on the respective seismic joists; and fastening the respective hangers to the respective seismic joists.

10. The method of claim 9 further comprising:

fastening the respective hangers to the ceiling grid.

11. The method of claim 9 further comprising:

selecting conventional joists of a length to extend between the tracks when mounted to the respective first wall and second wall;

selecting vertical supports to connect to the conventional joists and support the grid and of a length sufficient to, when the convention joists are positioned in the support plane, position the grid in the grid plane;

interposing the conventional joists between the tracks; and fastening the vertical supports to the conventional joists;

fastening the vertical supports to the ceiling grid.

12. The method of claim 11 further comprising:

at the construction site, installing a cable tray above one or more of the respective seismic joists and conventional joists.

13. The method of claim 11 wherein at least one conventional joist is positioned between each seismic joist.

14. The method of claim 9 wherein the step of selecting the seismic joists further comprises selecting seismic joists that have a hollow tubular cross-section.

15. The method of claim 14 wherein the step of selecting the seismic joists further comprises selecting tubular seismic joists that are box beams.

16. The method of claim 9 wherein the step of mounting the tracks in the support plane to the respective first wall and second wall further comprises mounting respective the tracks to a plurality of wall studs of the respective first wall and second wall.

17. The method of claim 9 wherein the step of mounting the tracks in the support plane to the respective first wall and second wall further comprises:

inserting a splice between a marginal end of a first respective track and a marginal end of a second respective track;

fastening the splice to the marginal end of the first respective track; and fastening the splice to the marginal end of the second respective track.

18. The method of claim 9 further comprising:

at the construction site, installing a cable tray above one or more of the respective seismic joists.

19. A method of pre-fabricating a collection of parts assembleable into a suspension system for supporting a ceiling grid in a horizontal grid plane over a room and resisting vertical and seismic forces comprising:

selecting tracks to be positioned in a horizontal support plane spaced above the grid plane, said tracks to be supported from a first wall and a second wall that is not perpendicular to and is spaced a distance apart from the first wall;

selecting seismic joists of a length to extend between the tracks when mounted to the respective first wall and second wall;

selecting a plurality of hangers, each of which comprises a metal hanger bracket rigidly affixable to a downwardly projecting vertical rigid lever arm that is connectable to the ceiling grid and wherein the rigid lever arm is of a length sufficient to, when the joists are positioned in the support plane, position the ceiling grid in the grid plane;

wherein each metal hanger bracket has an interior and an exterior, said exterior abutting one side of an upper extremity of the respective rigid lever arm, the interior of the metal hanger bracket defining a C-shaped bite that is configured to engage in close fit relationship over the top and bottom sides of each of the respective seismic joists;

configuring and sizing the seismic joists and hangers with a configuration to, when installed, position the grid in the grid plane.

20. The method of claim 19 further comprising:

selecting conventional joists of a length to extend between the tracks when mounted to the respective first wall and second wall;

selecting vertical supports to connect to the conventional joists and support the grid and of a length sufficient to, when the convention joists are positioned in the support plane, position the grid in the grid plane.

21. The method of claim 19 wherein the selecting seismic joists further comprises selecting seismic joists of at least six feet in length.

22. The method of claim 19 wherein the step of selecting a plurality of hangers further comprises boring at least one hole in each respective bracket.

23. A method for building a structure to support a ceiling grid and resist vertical and seismic forces comprising:

installing a first track comprising an elongated channel, with a back face and an open channel front face forming a nesting cavity, by mounting the first track to a first wall by attachment to a plurality of wall studs of said first wall, such that the back face is against the first wall and the open channel front face is facing away from the first wall;

installing a second track comprising an elongated channel, with a back face and an open channel front face forming a nesting cavity, by mounting the second track to a second wall that is parallel to and spaced a distance apart from said first wall, by attachment to a plurality of wall studs of said second wall such that the back face is against the second wall and the open channel front face is facing away from the second wall;

wherein the first track and the second track are each mounted at substantially the same height;

installing a plurality of seismic joists, each of said plurality of joists comprising a tubular steel beam with a height, a top, a bottom, a first end and a second end;

wherein upon installation, each of the plurality of seismic joists is mounted between and generally perpendicular to the first track and second track such that the first end of each of the plurality of seismic joists is mounted in the nesting cavity of the first track and the second end of each of the seismic joists is mounted in the nesting cavity of the second track, such that each of the plurality of seismic joists is rigidly affixed to said first track and said second track, and is generally perpendicular to and generally spans the distance between the first wall and the second wall;

installing on a plurality of seismic joists at least one seismic hanger comprising:

a rigid lever arm;

a bracket mounted on an upper extremity of said rigid lever arm such that said rigid lever arm projects downwardly from said bracket;

said bracket comprising a top flange and a bottom flange, wherein said top flange and said bottom flange form a front nesting face, said front nesting face having a height, wherein the height of the front nesting face is substantially the same as the height of each of the plurality of seismic joists; and wherein the seismic hanger is rigidly mounted on at least one of the plurality of seismic joists such that the top flange is affixed to the top of the respective seismic joist and the bottom flange is affixed to the bottom of the respective seismic joist.

24. The method of claim 23 further comprising:

installing a plurality of conventional joists, wherein each of the plurality of conventional joists is mounted between and generally perpendicular to the first track and second track such that the first end of each of the plurality of conventional joists is mounted in the nesting cavity of the first track and the second end of each of the plurality of conventional joists is mounted in the nesting cavity of the second track, such that each of the plurality of conventional joists is rigidly affixed to said first track and said second track, and generally spans the distance between the first wall and the second wall;

installing on a plurality of conventional joists, at least one vertical support.

25. The method of claim 24 wherein at least one conventional joist is installed between each seismic joist.

26. The method of claim 24 wherein the rigid lever arm of each of the plurality of hangers further comprises a steel angle.

27. The method of claim 24 wherein the rigid lever arm of each of the plurality of hangers further comprises a steel channel.

28. The method of claim 24 wherein the rigid lever arm of each of the plurality of hangers further comprises a steel stud.

29. The method of claim 24 further comprising:

installing a cable tray above one or more of the respective seismic joists and conventional joists.

* * * * *